US005809605A

United States Patent [19]

Gringer

[11] Patent Number: 5,809,605

[45] Date of Patent: Sep. 22, 1998

[54] SQUEEGEE ASSEMBLY

[75] Inventor: Donald Gringer, New York, N.Y.

[73] Assignee: Allway Tools, Inc., Bronx, N.Y.

[21] Appl. No.: 835,795

[22] Filed: Apr. 15, 1997

[51] Int. Cl.[6] ..... A47L 1/06; A47L 13/11; A47L 13/12

[52] U.S. Cl. ..... 15/121; 15/244.1; 15/245

[58] Field of Search ..... 15/121, 245, 117, 15/244.1, 250.451, 250.452, 250.48

[56] References Cited

U.S. PATENT DOCUMENTS

| | | | |
|---|---|---|---|
| 2,155,462 | 4/1939 | Anderson | 15/121 |
| 2,735,129 | 2/1956 | Lorenz | 15/245 X |
| 2,852,798 | 9/1958 | Grossfeld | 15/245 |
| 3,051,975 | 9/1962 | Schwartz | 15/245 X |
| 3,649,987 | 3/1972 | Tomingas et al. | 15/245 |
| 3,656,202 | 4/1972 | Paon | 15/121 |
| 3,676,888 | 7/1972 | Akers | 15/245 |
| 3,679,319 | 7/1972 | Munchel et al. | 410/138 |
| 3,685,085 | 8/1972 | Jaffa | 15/245 |
| 3,724,017 | 4/1973 | Mallory | 15/121 |
| 3,766,591 | 10/1973 | Soito | 15/245 |
| 3,783,469 | 1/1974 | Siemund | 15/209.1 |
| 3,795,933 | 3/1974 | Seufert | 15/114 |
| 3,837,747 | 9/1974 | Seymore | 401/25 |
| 3,892,005 | 7/1975 | Berns | 15/245 |
| 3,909,870 | 10/1975 | Leland | 15/121 |
| 3,950,813 | 4/1976 | Buck | 12/245 |
| 4,006,510 | 2/1977 | Teixeira Soares | 15/245 |
| 4,037,289 | 7/1977 | Dojan | 15/320 |
| 4,047,480 | 9/1977 | Vassiliou | 101/123 |
| 4,075,730 | 2/1978 | Siemund | 15/245 |
| 4,085,478 | 4/1978 | Bailes et al. | 15/245 |
| 4,107,812 | 8/1978 | Lantto | 15/245 |
| 4,118,822 | 10/1978 | Gitter | 15/121 |
| 4,122,771 | 10/1978 | Barton et al. | 101/123 |
| 4,124,915 | 11/1978 | Schlicher | 15/105 |
| 4,138,759 | 2/1979 | Voorhees | 15/245 |
| 4,152,807 | 5/1979 | Smahlik | 15/246 |
| 4,236,270 | 12/1980 | Mavis | 15/245 |
| 4,240,176 | 12/1980 | Farmer | 15/121 |
| 4,336,624 | 6/1982 | Pichelman et al. | 15/245 |
| 4,339,838 | 7/1982 | Pekarek | 15/245 |

(List continued on next page.)

FOREIGN PATENT DOCUMENTS

| | | | |
|---|---|---|---|
| 642066 | 6/1962 | Canada | 15/121 |
| 1191306 | 8/1985 | Canada | 15/245 |

*Primary Examiner*—Mark Spisich
*Attorney, Agent, or Firm*—David M. Klein; Shearman & Sterling

[57] ABSTRACT

A squeegee assembly includes i) a handle having a male blade-mounting portion; and ii) a dual-extruded squeegee blade having a resilient squeegee portion and a channel. The channel is constructed of a generally semi-rigid material and is sized and shaped to be slidably mounted to the male blade-mounting portion of the handle. The handle is constructed of a molded thermoplastic or a stamped metal and includes a gripping area. The dual-extruded squeegee blade is constructed of compatible vinyls, elastomers, or other thermoplastics. The squeegee portion is chevroned, with the chevron defining a pair of cleaning members, so that the squeegee blade is reversible. In an alternative embodiment, the squeegee blade includes a sponge extruded therewith. In a further alternative embodiment, the squeegee blade includes a second channel extruded therewith and an extruded sponge adapted to be slidably insertable into the second channel.

16 Claims, 3 Drawing Sheets

U.S. PATENT DOCUMENTS

| | | | |
|---|---|---|---|
| 4,364,142 | 12/1982 | Pangle | 15/117 |
| 4,381,575 | 5/1983 | Wendt | 15/245 X |
| 4,386,493 | 6/1983 | Kubick | 15/245 |
| 4,398,839 | 8/1983 | Kluck | 401/263 |
| 4,430,769 | 2/1984 | Bergström | 15/245 |
| 4,602,401 | 7/1986 | Holroyd | 15/245 |
| 4,607,411 | 8/1986 | Lewis, Jr. | 15/117 |
| 4,611,363 | 9/1986 | Samuelsson | 15/245 |
| 4,697,296 | 10/1987 | Smahlik | 15/245 |
| 4,716,616 | 1/1988 | Poon | 15/245 |
| 4,727,986 | 3/1988 | Feldstein | 206/229 |
| 4,742,595 | 5/1988 | Isaacs | 15/105 |
| 4,747,175 | 5/1988 | Durgin | 15/105 |
| 4,787,113 | 11/1988 | Kamenske | 15/245 |
| 4,807,322 | 2/1989 | Littledeer | 15/121 |
| 4,893,370 | 1/1990 | Klotz | 15/121 |
| 4,910,825 | 3/1990 | Mauer | 15/121 |
| 4,941,238 | 7/1990 | Belanger et al. | 15/245 |
| 4,977,637 | 12/1990 | Demers | 15/245 X |
| 5,074,027 | 12/1991 | Alviar et al. | 29/525 |
| 5,075,985 | 12/1991 | Mensch | 37/117.5 |
| 5,078,063 | 1/1992 | Johansen et al. | 101/480 |
| 5,101,530 | 4/1992 | Hansen et al. | 15/245 |
| 5,175,902 | 1/1993 | Samuelsson | 15/245 |
| 5,184,372 | 2/1993 | Mache | 15/401 |
| 5,212,848 | 5/1993 | Geyer | 15/401 |
| 5,321,868 | 6/1994 | Coulson et al. | 15/245.1 |
| 5,343,586 | 9/1994 | Vosbikian | 15/121 |
| 5,347,676 | 9/1994 | Saitoh | 15/245 |
| 5,349,716 | 9/1994 | Millar | 15/245 |
| 5,363,528 | 11/1994 | Brock | 15/121 |
| 5,377,382 | 1/1995 | Bores et al. | 15/340.1 |
| 5,381,581 | 1/1995 | Samuelsson | 15/245 |
| 5,419,007 | 5/1995 | Hult et al. | 15/401 |
| 5,429,678 | 7/1995 | Fany | 134/6 |
| 5,458,060 | 10/1995 | Casl | 101/123 |
| 5,487,203 | 1/1996 | Brach, Jr. et al. | 15/245 |
| 5,507,052 | 4/1996 | Smith et al. | 7/151 |

SQUEEGEE ASSEMBLY

BACKGROUND OF THE INVENTION

1. Field of the Invention

The present invention relates generally to a squeegee and more particularly to a squeegee in which the handle is molded or stamped and includes a male portion for mounting a squeegee blade, and in which the squeegee blade is dual or triple-extruded and includes a female portion so as to be slidable onto the handle.

2. Description of the Related Art

Squeegees are well known in the art and are utilized for cleaning glass, e.g., windows and windshields, tiles, floors, and other flat surfaces. A typical squeegee of the type having a replaceable blade includes a T-shaped handle and a squeegee portion mounted to the handle. The cross-bar of the T-shaped handle includes non-spreadable jaws that define an elongate slot (the female portion). The squeegee portion includes a squeegee blade, which is constructed of rubber, flexible plastic or other resilient material, and a rigid portion fixed to and aligned with the squeegee blade (the male portion) that is sized to be inserted into the female portion for mounting the squeegee portion to the T-shaped handle. Squeegees of this type are shown, for example, in U.S. Pat. Nos. 3,892,005; 4,107,812; 4,336,624; 4,386,443; 4,430,769; and 4,611,363. Most of these squeegees are constructed with multi-piece handles or blades, and are constructed with a number of different types of materials, e.g., metals, rubber, etc., which increases the cost of manufacturing such squeegees.

In order to overcome these deficiencies, U.S. Pat. No. 4,075,730 discloses a completely non-metallic squeegee which comprises a hollow, relatively rigid, plastic T-shaped handle onto which is mounted an integral squeegee that is dual-extruded, i.e., is formed of two different durometers of plastic material. The squeegee includes a rigid backbone portion and an elastomeric squeegee blade. The backbone portion is inserted endwise between rigid non-spreadable jaws formed in the cross-bar portion of the handle. The handle is constructed of a molded synthetic resin or plastic.

In this type of squeegee, the handle includes a female portion constructed of opposed jaws, with the male portion on the blade being slidably inserted between the jaws. In order to form such a plastic handle with opposed jaws it is necessary to mold the handle. If the handle is molded as one piece, the mold and molding are quite expensive as movable slides must be used to pull cores laterally in the mold to make the female undercut between the jaws. The core pull distance limits the width the squeegee handle can be molded. The handle may be molded under-cut and over-cut, as shown in U.S. Pat. No. 4,430,769, but this type of handle is not aesthetically pleasing, is weaker than the full jaw design, and is difficult to assemble. If a handle with a full-jaw design is to be stamped of a metal, it is stamped from a metal, the handle must be constructed of more than one piece in order to form both clamping members.

Thus, a need exists for a squeegee that utilizes a dual-extruded blade in which the handle may be manufactured using a simple mold without a core pull or that may be stamped of one-piece construction.

SUMMARY OF THE INVENTION

The present invention is a squeegee assembly which includes i) a handle comprising a male blade-mounting portion; and ii) a dual-extruded squeegee blade comprising a resilient squeegee portion and a channel. The channel is defined by opposed jaws that are constructed of a generally semi-rigid material, and is sized and shaped to be slidably mounted on the male blade-mounting portion of the handle. The handle is constructed of a molded thermoplastic or a stamped metal and includes a gripping area. The dual-extruded squeegee blade is constructed of a vinyl or other thermoplastic. The squeegee portion is preferably chevroned, the chevron defining a pair of cleaning members. In this embodiment, the squeegee blade is reversible on the handle.

In an alternative embodiment, the squeegee blade includes a sponge extruded therewith. In a further alternative embodiment, the squeegee blade includes a second channel extruded therewith and an extruded sponge adapted to be slidably insertable into the second channel.

DETAILED DESCRIPTION OF THE INVENTION

Figure 2:
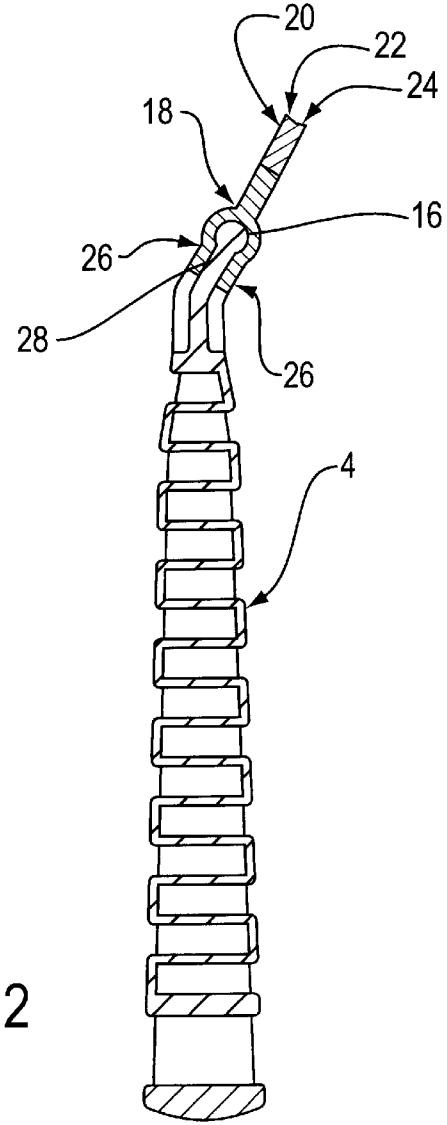
FIG. 2 is a cross-sectional view through Section 2—2 of FIG. 1.
Figure 1:
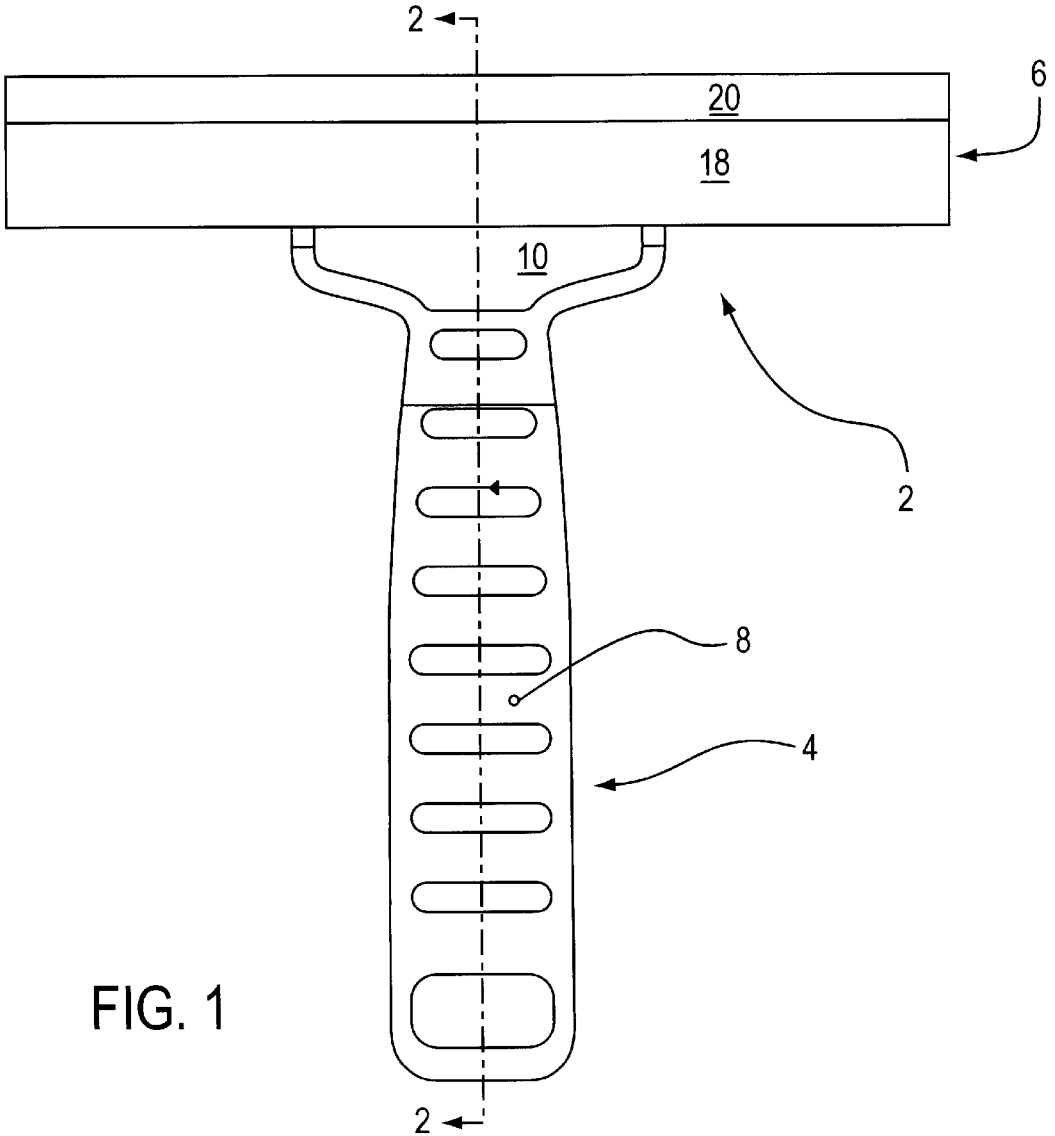
FIG. 1 is a front view of a squeegee assembly in accordance with the present invention.
Figure 4:
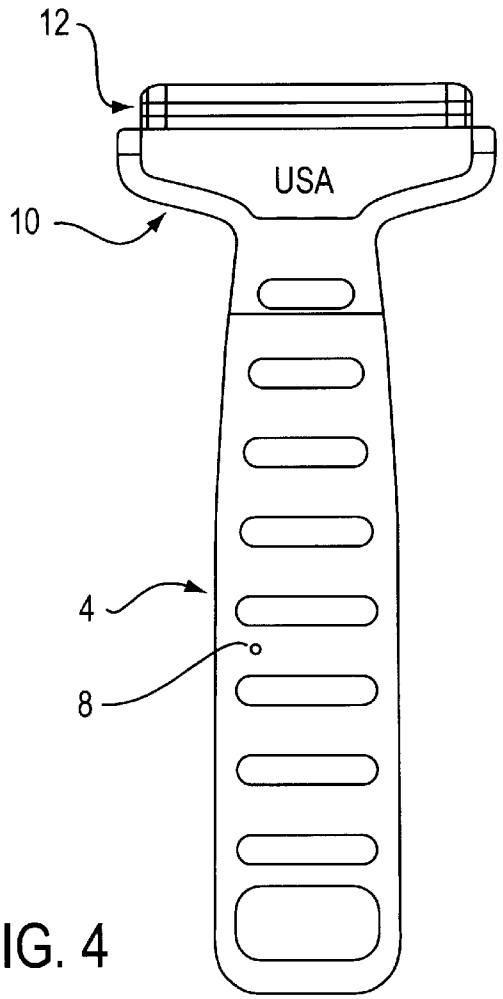
FIG. 4 is a rear view of the squeegee handle shown in FIG. 3.
Figure 5:
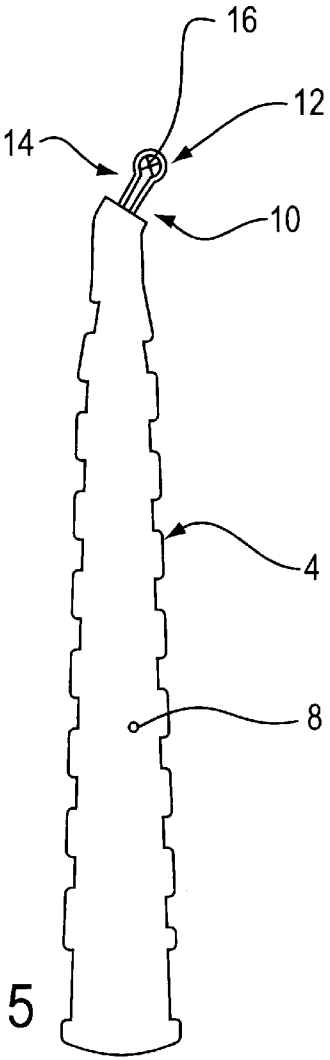
FIG. 5 is a side view of the squeegee handle shown in FIG. 3.
Figure 3:
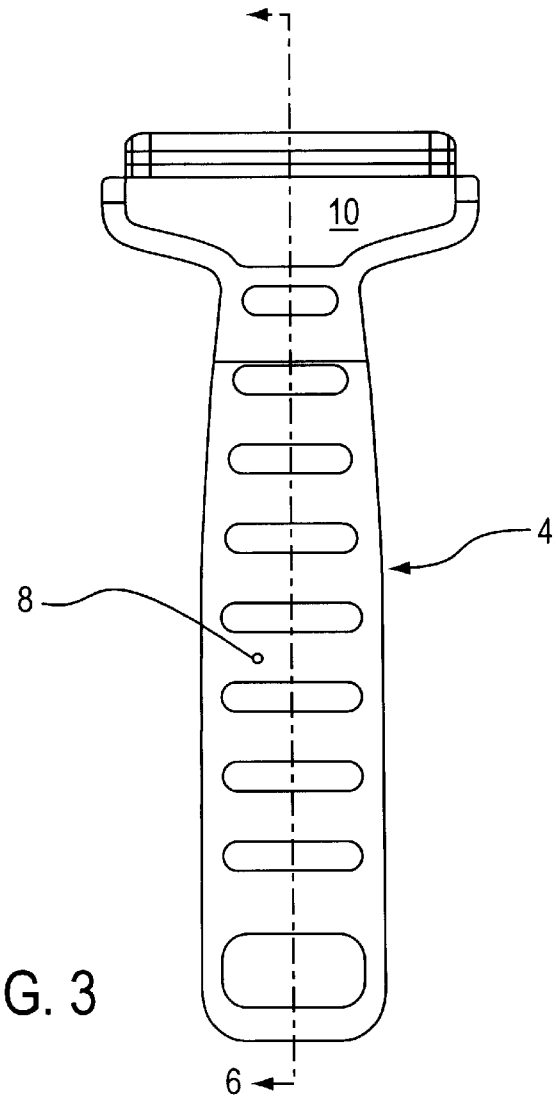
FIG. 3 is a front view of a squeegee handle in accordance with the present invention.

As shown in FIGS. 1 and 2, the present invention is a squeegee 2 that is constructed of a handle 4 and a blade 6. As shown in FIGS. 3–6, handle 4 is preferably of one-piece construction and is manufactured of a generally rigid molded thermoplastic, such as a hard vinyl, e.g., PVC, acetal resin, or polypropylene or is stamped from any appropriate metal, preferably in a one-piece construction. Handle 4 includes a grip 8 adapted to be hand-held. In the embodiment shown, handle 4 includes a ribbed ornamental design that is not material to the invention. A distal end 10 of handle 4 is widened and adapted to receive blade 6. A male blade receiving portion 12 is integrally molded with handle 4 and includes an upstanding portion 14 terminating in a rounded bulbous end 16.

As shown in FIGS. 1 and 2, blade 6 is preferably constructed with a fixed cross-section so as to enable the blade to be extruded. Blade 6 is preferably dual-extruded and includes a mounting side 18 and a squeegee side 20. Mounting side 18 is preferably a hard vinyl or other semi-rigid material, e.g., polypropylene. Squeegee side 20 is preferably a flexible soft material compatible with the material of mounting side 18, such as a flexible soft vinyl or an elastomer, of the type suitable for cleaning glass or the like at cleaning surfaces 22, 24. Cleaning surfaces 22, 24 are preferably separated by a chevron. Alternatively, the cleaning edge of the squeegee may have a square or other desired cross-section. Mounting side 18 includes a pair of mounting arms 26 that define a channel 28. To assemble the squeegee, channel 28 of blade 6 is aligned with and slid onto the bulbous end 16 of handle 4. The bulbous or male end and channel are preferably sized so that the blade is frictionally engaged on the handle, but may be removed for replacement without undue force. Blade 6 is reversible so that when one of the cleaning surfaces, e.g., cleaning surface 22, wears out, the blade may be reversed to enable the other cleaning surface, e.g., cleaning surface 24, to be utilized.

It will be appreciated that blade 6 may be constructed of any appropriate material(s) that may be dual extruded in which a portion of the extrusion is semi-rigid for attachment to the handle, and in which another portion thereof is relatively resilient so as to perform the squeegee function. It will also be appreciated that the size and shape of the handle or squeegee may be altered as desired. For example, handle 4 may be longer to enable cleaning at a distance, or may include a female threaded portion for attachment to a conventional extension stick. The squeegee-receiving end of the handle may also be angled differently.

Figure 6:
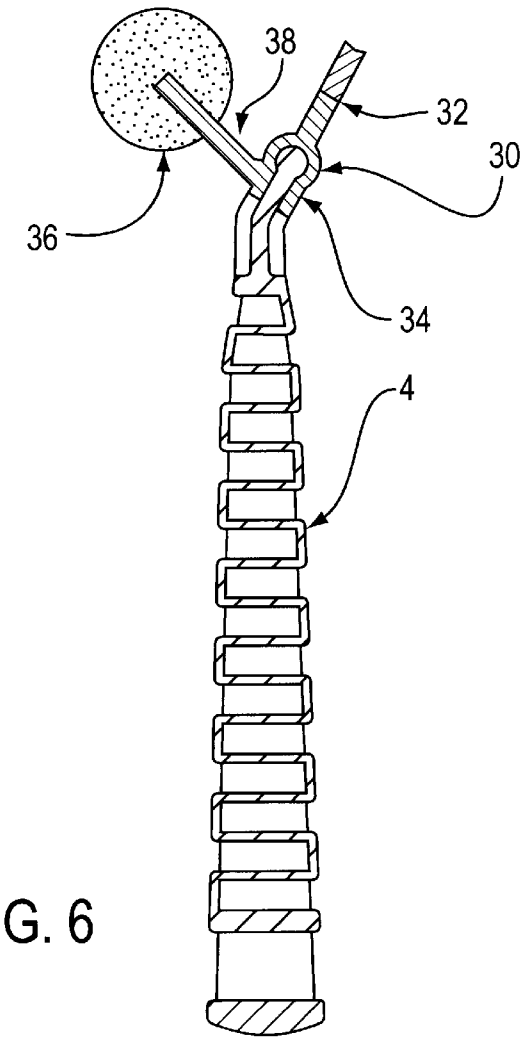
FIG. 6 is a section view of an alternative squeegee assembly in accordance with the present invention.

In an alternative embodiment, as shown in FIG. 6, squeegee blade 30 is triple extruded and includes, in addition to a squeegee portion 32 and a mounting portion 34, a sponge 36 that is extruded with the blade. An extension arm 38, which is preferably made of the semi-rigid material of mounting portion 34, extends to within sponge 36. Sponge 36 is constructed of a foam material suitable for extrusion and compatible with the material of the remainder of the blade. In use, the sponge is used to wash a window or the like, and squeegee portion 32 is then used to clean and dry the window. Sponge 36 is preferably the same width as squeegee portion 32.

Figure 7:
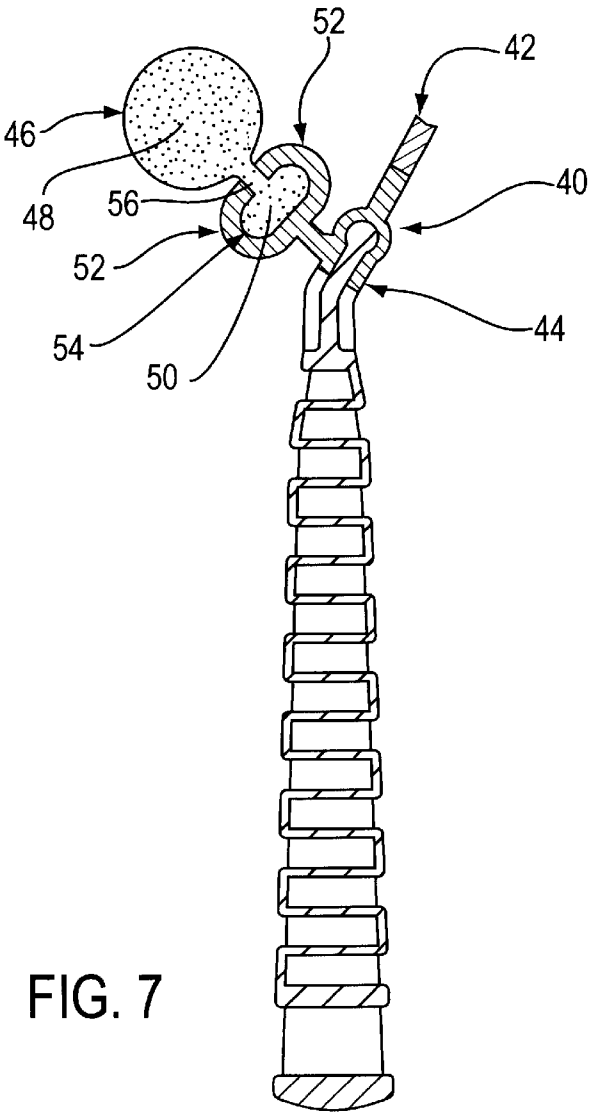
FIG. 7 is a section view of a further alternative squeegee assembly in accordance with the present invention.

In another alternative embodiment, as shown in FIG. 7, squeegee blade 40 is dual extruded and includes, in addition to a squeegee portion 42 and a mounting portion 44, a channel 50 formed by rounded members 52. Rounded members 52 are preferably constructed of the semi-rigid material of mounting portion 44, and extruded therewith. A separately extruded sponge 46 includes a sponge head 48, an insert end 54 sized and shaped to be inserted into and to frictionally engage with channel 50, and an extension 56 extending therebetween. For additional strength, sponge 56 may be dual-extruded with insert end 54 and/or extension 56 constructed of a more rigid material.

Although the present invention has been described in detail with respect to certain embodiments and examples, variations and modifications exist that are within the scope of the present invention as defined in the following claims.

I claim:

1. A squeegee assembly which comprises:

(a) an elongated handle having a longitudinal axis and a male blade-mounting portion at an end thereof, the male blade-mounting portion comprising an elongated upstanding member oriented transverse with respect to the longitudinal axis of the handle, the elongated upstanding member comprising a bulbous portion at a free end thereof; and (b) an elongated dual-extruded squeegee blade comprising a one-piece extrusion having a resilient squeegee portion and a semi-rigid portion constructed of a semi-rigid material which is more rigid than the resilient squeegee portion, the semi-rigid portion of the squeegee blade having a channel formed therein which is shaped to slidably receive the male blade-mounting portion of the handle, the channel being open along at least one end thereof and along a longitudinal axis thereof, the channel having a first narrow portion corresponding to the upstanding member and a second enlarged portion corresponding to the bulbous portion.

2. The squeegee assembly according to claim 1 wherein the handle is constructed of a molded thermoplastic.

3. The squeegee assembly according to claim 1 wherein the handle is constructed of a stamped metal.

4. The squeegee assembly according to claim 1 wherein the dual-extruded squeegee blade is constructed of a vinyl or other thermoplastic.

5. The squeegee assembly according to claim 1 wherein the squeegee portion is chevroned and comprises a pair of cleaning members.

6. The squeegee assembly according to claim 5 wherein the squeegee blade is reversible.

7. The squeegee assembly according to claim 1 wherein the squeegee blade further comprises a sponge extruded therewith.

8. The squeegee assembly according to claim 1 wherein the squeegee blade further comprises a second channel extruded therewith, the squeegee assembly further comprising a sponge adapted to be slidably insertable into the second channel.

9. The squeegee assembly according to claim 1 wherein the handle comprises a gripping area.

10. The squeegee assembly according to claim 1 wherein the squeegee blade comprises opposed jaws defining the channel.

11. The squeegee assembly according to claim 1 wherein the squeegee blade is constructed of a vinyl, elastomer, or other thermoplastic.

12. The squeegee assembly according to claim 1 wherein the squeegee portion is chevroned and comprises a pair of cleaning members.

13. The squeegee assembly according to claim 12 wherein the squeegee blade is reversible.

14. The squeegee assembly according to claim 1 further comprising a sponge extruded integral with the squeegee blade and the channel.

15. The squeegee assembly according to claim 1, wherein the squeegee blade further comprises a second channel, the squeegee assembly further comprising a sponge portion adapted to be slidably mounted to the second channel.

16. An improved squeegee blade for use in combination with a squeegee handle, the squeegee blade being an elongated one-piece extrusion having a resilient squeegee portion and a semi-rigid portion constructed of a semi-rigid material which is more rigid than the resilient squeegee portion, the semi-rigid portion of the squeegee blade having means for being mounted to the handle, the improvement comprising:

a sponge portion integrally extruded with the resilient squeegee portion and the semi-rigid portion, the sponge portion being constructed of a sponge material.

* * * * *